US006087610A

United States Patent [19]

Castonguay et al.

[11] Patent Number: 6,087,610

[45] **Date of Patent: *Jul. 11, 2000**

[54] CLOSING SPRINGS RELEASE MECHANISM FOR INDUSTRIAL-RATED CIRCUIT BREAKER

[75] Inventors: Roger N. Castonguay, Terryville; James L. Rosen, West Hartford; Andre J. M'Sadoques; Dean A. Robarge, both of Southington, all of Conn.

[73] Assignee: General Electric Company, Schenectady, N.Y.

[ * ] Notice: This patent is subject to a terminal disclaimer.

[21] Appl. No.: 08/864,165

[22] Filed: May 28, 1997

[51] Int. Cl.[7] ..... H01H 3/00; H01H 5/00

[52] U.S. Cl. ..... 218/154; 200/400

[58] Field of Search ..... 200/50.01, 400, 200/401, 323, 327; 218/154

[56] References Cited

U.S. PATENT DOCUMENTS

| | | | |
|---|---|---|---|
| 3,084,238 | 4/1963 | Baskerville | 200/153 |
| 3,095,489 | 6/1963 | Baird | 200/153 |
| 3,729,065 | 4/1973 | Baskerville et al. | 185/39 |
| 4,167,988 | 9/1979 | Acampora et al. | 185/40 R |
| 4,475,021 | 10/1984 | Yoshinori et al. | 200/153 SC |
| 4,672,501 | 6/1987 | Bilac et al. | 361/96 |
| 5,488,211 | 1/1996 | Castonguay | 200/400 |
| 5,495,082 | 2/1996 | Zaffetti et al. | 200/400 |
| 5,521,346 | 5/1996 | Castonguay | 200/401 |

OTHER PUBLICATIONS

08/863667, R.N. Castonguay & J.I. Smith, *"Manual Charging Mechanism for Industrial–Rated Circuit Breaker"*, May 27, 1997.

*Primary Examiner*—Wynn Wood Coggins
*Assistant Examiner*—Michael J. Hayes
*Attorney, Agent, or Firm*—Fishman, Dionne, Cantor & Colburn

[57] ABSTRACT

An air circuit breaker ratcheting mechanism includes a ratchet and pawl whereby the closing springs charging gear is prevented from reverse rotation during the closing springs charging operation. Upon completion of the charging operation, the ratchet and pawl become disengaged from the charging gear to allow the closing springs to respond to a manual closing button depression. A holding prop within the ratcheting mechanism interacts with a roller bearing on the charging shaft to prevent reverse rotation of the charging shaft under the bias provided by the charged closing springs.

8 Claims, 5 Drawing Sheets

CLOSING SPRINGS RELEASE MECHANISM FOR INDUSTRIAL-RATED CIRCUIT BREAKER

BACKGROUND OF THE INVENTION

Air circuit breakers as described within U.S. Pat. Nos. 3,095,489 entitled "Manual Charging Means for Stored Energy Closing Mechanisms of Electric Circuit Breakers" and 3,084,238 entitled "Ratchet Mechanism for Charging a Closing Spring in an Electric Circuit Breaker" include operating mechanisms that are mainly exposed to the environment. Since the air circuit breakers are rated to carry several thousand amperes of current continuously, the exposure to convection cooling air assists in keeping the operating components within reasonable temperature limits.

Such air circuit breakers are usually provided with a motor operator such as described in U.S. Pat. No. 4,167,988 entitled "Ratcheting Mechanism for Circuit Breaker Motor Operator" or a manual handle as described in U.S. Pat. No. 3,729,065 entitled "Means for Charging A Stored Energy Circuit Breaker Closing Device" for charging the powerful closing springs contained within the air circuit breaker operating mechanism.

As described within the aforementioned U.S. Pat. No. 4,167,988, the ratchet mechanism includes a driving pawl coupled with the motor operator for incrementally advancing a ratchet wheel coupled with the circuit breaker operating mechanism. Each incremental advance of the ratchet wheel is sustained by a holding pawl. Ultimately, the ratchet wheel is advanced to an angular position where the circuit breaker closing springs are fully charged and therefore empowered to forcibly close the circuit breaker contacts. Typically, the discharge of the closing springs rapidly drives the ratchet wheel in the same direction as did the driving pawl in charging the closing springs. In the process, the teeth on the ratchet wheel impact with the driving and holding pawls, producing undue pawl and ratchet wear, as well as unnecessary stress on the pawl springs and mountings. Moreover, when the breaker contacts close, there is an inevitable rebound which tends to rotate the holding pawl. Under these circumstances, the straight sides of the ratchet teeth impact against the straight edges of the pawl tips, causing potentially damaging stresses in the ratcheting mechanism. The patent further suggests the use of a holding prop to hold the pawls out of engagement with the ratchet wheel until the closing springs have fully discharged to protect the pawls and the ratchet wheel from potential damage. When the contacts have become closed, the circuit breaker operating mechanism components are exposed to allow an operator to manually release the holding prop in order for the holding pawl to again become operative in re-charging the circuit breaker closing spring.

When the circuit breaker closing springs are brought to their fully-charged conditions, it is important that the springs do not become inadvertently discharged while an operator has hold of the charging handle in order to avoid damage to the ratchet mechanism and the associated air circuit breaker contacts. An early arrangement of a latching means to prevent rotation of a closing springs charging handle is found in U.S. Pat. No. 4,475,021 entitled "Air Circuit Breaker".

When the circuit breaker closing springs are completely charged, the holding pawl is removed from the charging gear to allow the charging shaft to rotate in the reverse direction when the circuit breaker closing button is activated, as described in U.S. patent application Ser. No. 08/863,649 entitled "Ratcheting Mechanism for an Industrial-Rated Circuit Breaker" filed on May 27, 1997. With the holding pawl removed from the charging gear, the closing springs exert a force of rotation on the charging shaft and some means must be employed to assure that the charging shaft remains in a closing springs "charged condition" until and unless the circuit breaker closing button is activated.

One purpose of the invention is to provide a means for retaining the circuit breaker closing springs in a charged condition until the circuit breaker closing button is activated and to allow the closing springs to immediately respond thereafter.

SUMMARY OF THE INVENTION

An air circuit breaker ratcheting mechanism includes a ratchet and pawl whereby the closing springs charging gear is prevented from reverse rotation during the closing springs charging operation. Upon completion of the charging operation, the ratchet and pawl become disengaged from the charging gear when the charged closing springs are released in response to a manual closing button depression. A holding prop within the ratcheting mechanism interacts with a roller bearing on the charging shaft to prevent further rotation of the charging shaft under the bias provided by the charged closing springs. A bell crank and release lever interface with the ratcheting mechanism holding prop and the circuit breaker closing button by means of a push rod-guide tube assembly. The push rod-guide tube assembly is arranged to allow for tolerance variation.

BRIEF DESCRIPTION OF THE DRAWINGS

FIGS. 1 and 1A are views of an air circuit breaker containing a modular ratcheting mechanism that includes the circuit breaker closing springs release mechanism according to the invention;

DESCRIPTION OF THE PREFERRED EMBODIMENT

Figure 1:
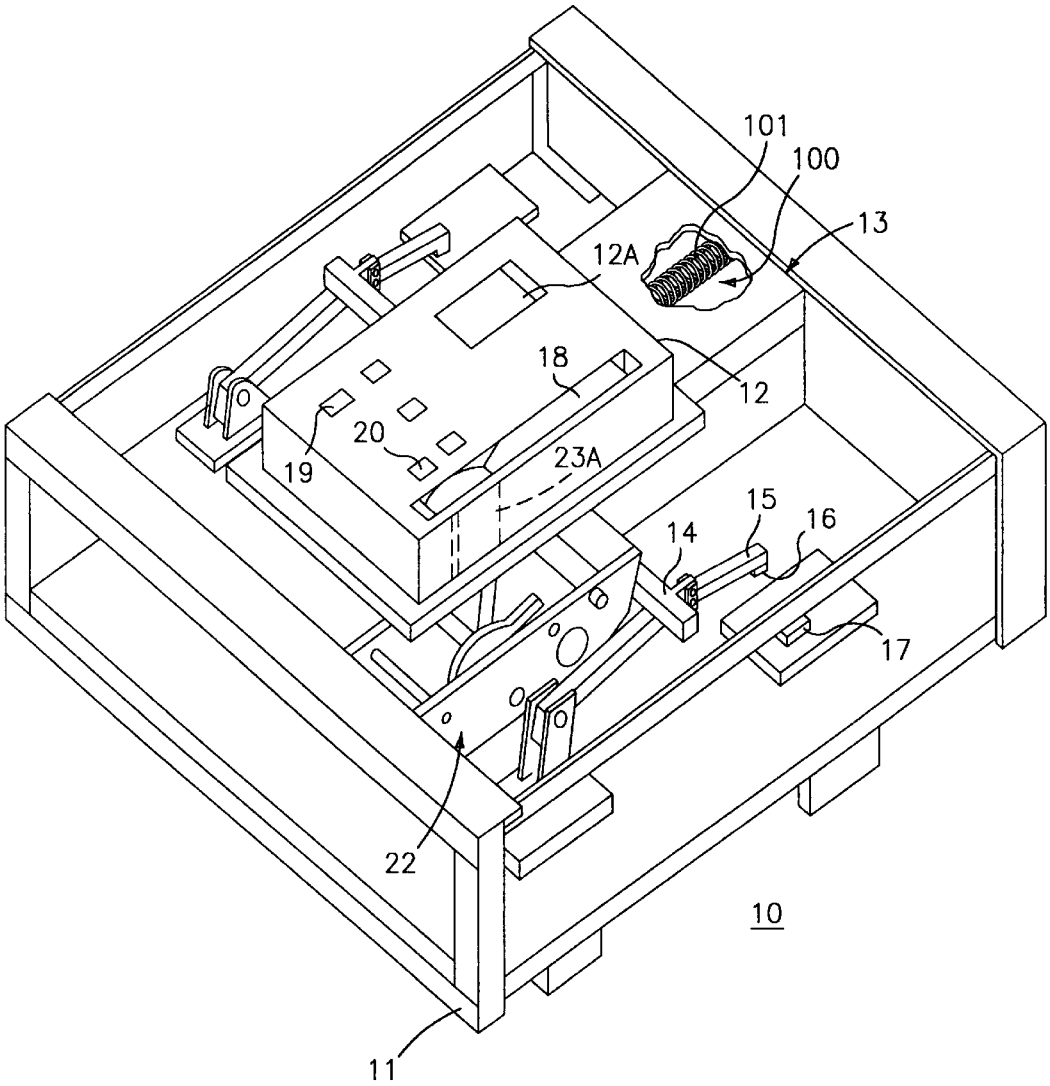

The air circuit breaker 10 of FIG. 1 is similar to that described within the aforementioned U.S. Pat. No. 3,095,489 and includes a metal frame 11 which supports circuit breaker cover 12, the trip unit programmer 12 A and the operating mechanism enclosure 13. The trip unit programmer is similar to that described in U.S. Pat. No. 4,672,501 entitled "Circuit Breaker and Protective Relay Unit". The cover further includes a trip button 19 for releasing the circuit breaker operating mechanism contained within the enclosure 13 for separating the circuit breaker contacts 16, 17 to their open condition and a closing button 20 for moving the contacts to their closed position. The circuit breaker contact arms 15 within each pole of a three pole circuit arrangement, are interconnected by means of the operating mechanism crossbar 14 to insure that all contacts within the separate poles both open and close in unison. The modular ratcheting mechanism 22 improves over the earlier mechanism described in the aforementioned U.S. Pat. No. 3,729,065 by allowing the operating mechanism 100 closing springs 101 described therein to be charged remotely by means of a motor operator. The operating handle 18 interacts with the ratcheting mechanism 22 by means of a pair of plate connectors, one of which is indicated at 23A. The operating mechanism 100 shown in FIG. 1A includes trip mechanism 9 which interacts with the operating mechanism to open contacts 16, 17 and further includes closing spring 101 which is charged via coupling assembly 42 and also interacts with the operating mechanism to close the contacts.

Figure 2:
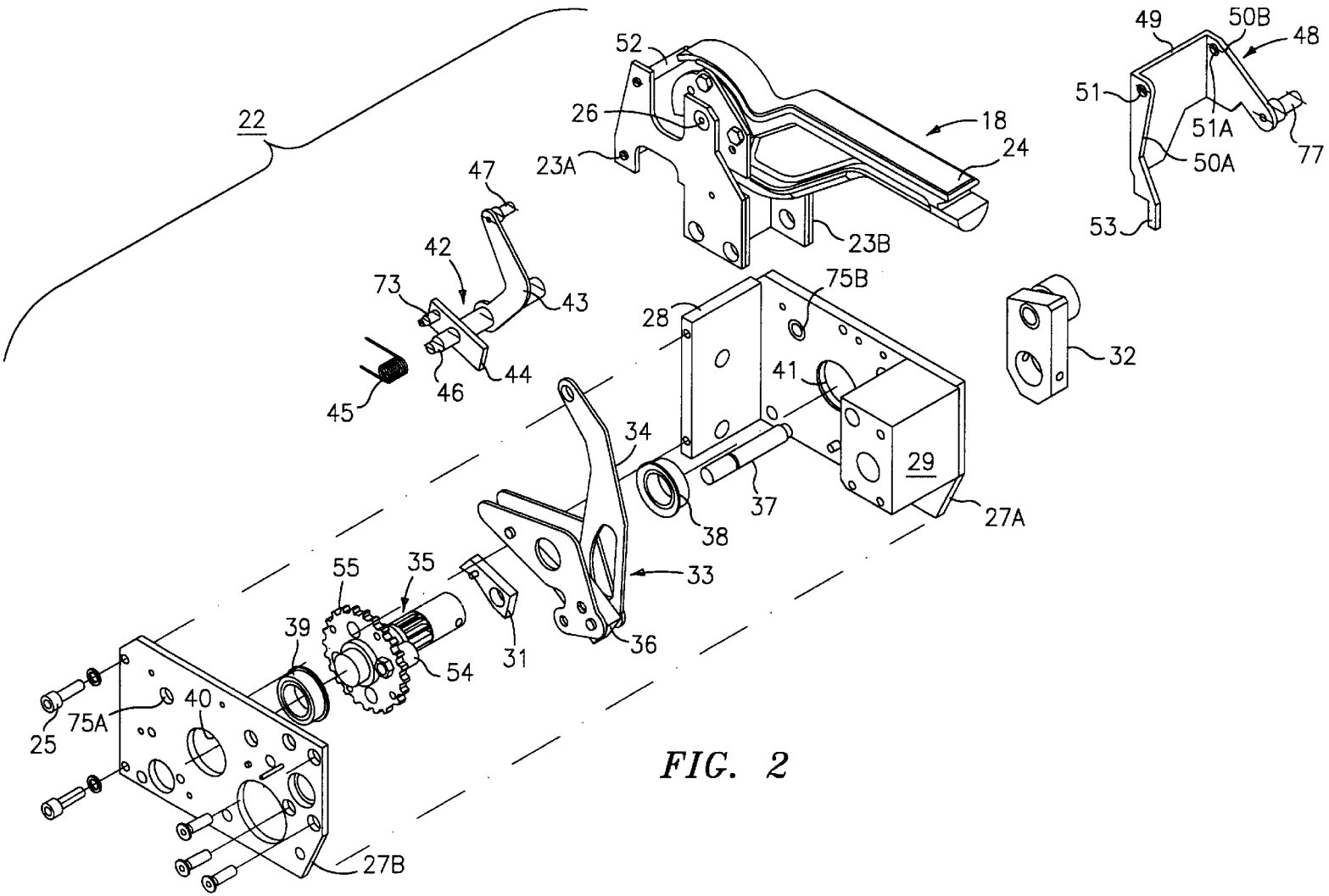
FIG. 2 is a top perspective view of the ratcheting mechanism of FIG. 1 with the components in isometric projection prior to assembly.

The operating handle 18 within the ratcheting mechanism 22 is shown in FIG. 2 wherein the operating handle includes a handle extension 24 assembled onto a pair of connector plates 23A, 23B and attached to the ratchet mechanism sideframes 27A, 27B by the handle pivot 26. The ratchet mechanism sideframes 27A, 27B are separated by means of block spacers 28, 29 which are connected to the sideframes by means of bolts 25. The charging crank 33 and intervening charging pawl 36 interact with the operating handle 18 by means of the charging link 34 in the manner described within U.S. patent application Ser. No. 08/863,667 entitled "Manual Charging Mechanism for Industrial-Rated Circuit Breaker" filed on May 27, 1997. The holding pawl 31 is connected within the side frames 27A, 27B by means of the ratchet pawl pivot pin 37 that extends through the openings 40, 41 formed within the sideframes 27B, 27A respectively and flanges 38, 39. The holding pawl 31 interacts with the charging gear 55 to prevent reverse rotation of the charging shaft 35 during the charging of the circuit breaker closing springs 101 by means of the circuit breaker operating mechanism coupler 32 as described within the referenced U.S. patent application Ser. No. 08/863,667. When the closing springs are fully charged a bell crank 42 is used in accordance with the invention. The bell crank includes a lever arm 43 with a release pin 47 extending from one end and connects with a holding prop 44 by means of the pivot shaft 46 at the opposite end thereof. The holding prop 44 is biased in the clockwise direction by means of a spiral prop spring 45 that is arranged about the pivot shaft 46 extending from a central part of the holding prop and engages the spring post 73 at one end. The pivot shaft 46 also serves to pivotally support the bell crank 42 onto the ratcheting mechanism sideframes 27A, 27B by means of apertures 75A, 75B. In the manner to be seen below, the roller bearing 54 extending from the charging gear 55 on the charging shaft 35 stops against the end of the holding prop 44 to prevent rotation of the charging shaft before the holding pawl 31 is released. To later allow the rotation of the charging shaft 35 to release the circuit breaker closing springs 101, the release lever 48 which pivotally attaches to the top of the connector plate 23A by means of the pivot post 52 and apertures 51, 51A is employed. The release lever 48 is in the form of a U-shaped piece defining a back plate 49 with side arms 50A, 50B extending therefrom. A release pin 77 extends outwards from the sidearm 50B and is received within push rod-guide tube assembly 56 (FIG. 3) and the release tab 53 extending from the bottom of the sidearm 50A captures the release pin 47 on the bell crank 42 that will be described below with reference to FIGS. 3–6.

Figure 4:
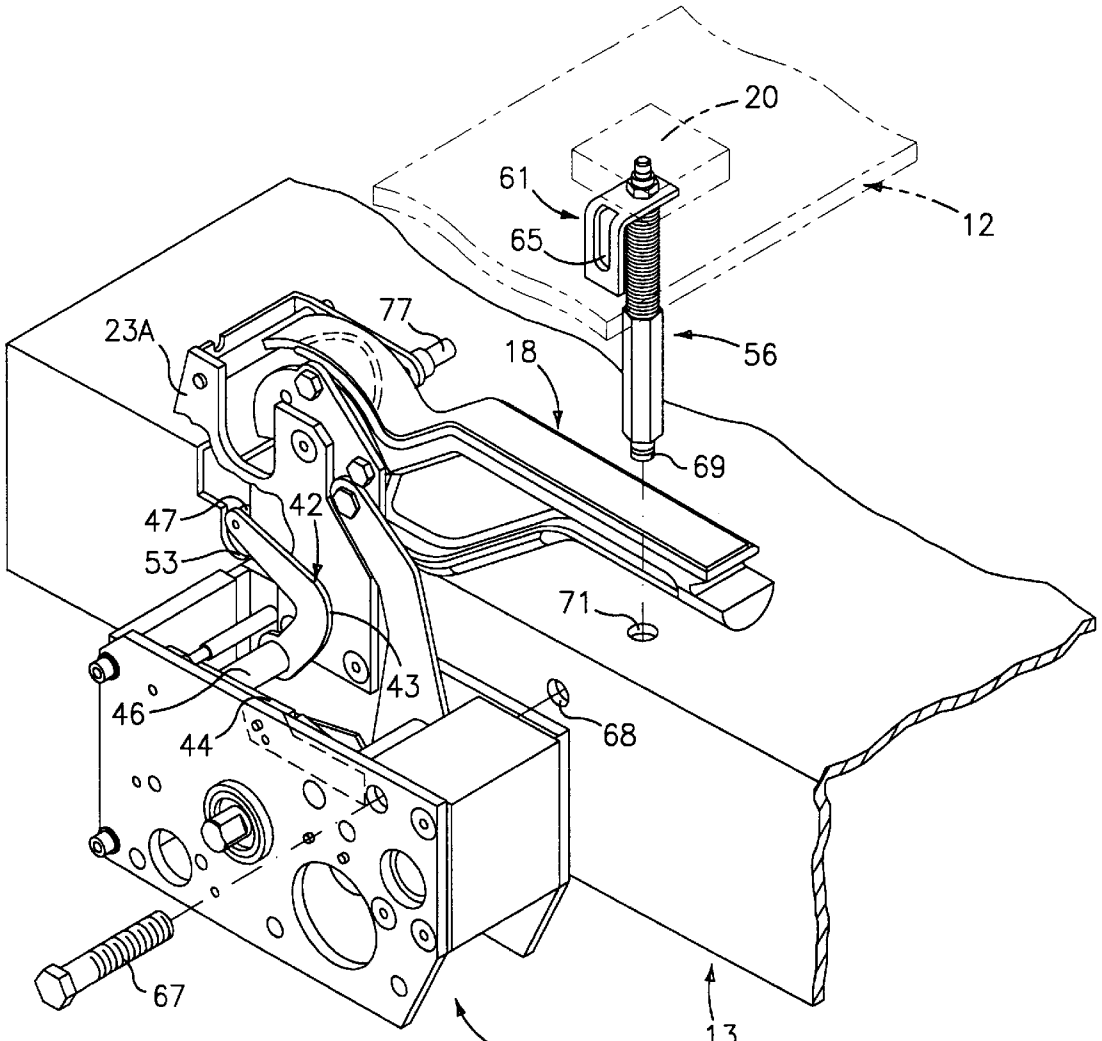
FIG. 4 is an enlarged top view of the modular ratcheting mechanism of FIG. 1 prior to attachment to the circuit breaker operating mechanism enclosure and prior to insertion of the push rod guide-tube assembly.
Figure 3:
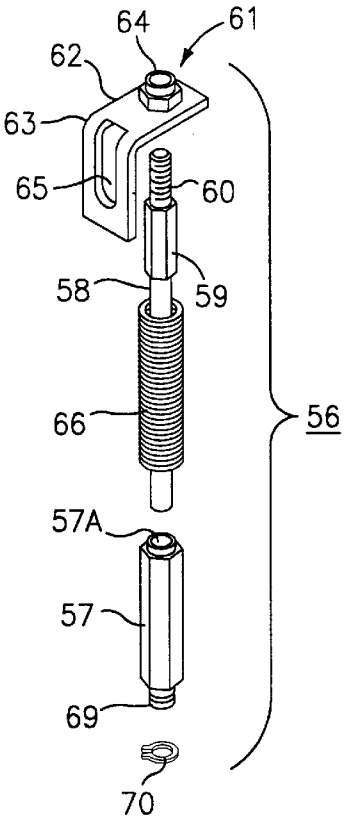
FIG. 3 is an exploded front perspective view of the push rod guide-tube assembly within the ratcheting mechanism of FIG. 1.

An additional feature of the invention is the use of a tolerance-compensating push rod-guide tube assembly 56 as shown in FIG. 3. A hexagonal rod 57 having an extending aperture 57A therethrough terminates at on end with male threads as indicated at 69. An elongated rod 58 is inserted within the aperture and is secured at one end by means of a horse shoe clip 70. A spiral spring 66 is positioned over the rod 58 and an L-shaped plate 61 is threaded onto the end 60 by means of the lock nut 64 that positions the top part 62 of the L-shaped plate against the end of the extended surface 59 formed on the rod 58. The side arm 63 of the L-shaped plate 61 includes an elongated slot 65 formed therein for receiving the release pin 77 as shown in FIG. 4.

The ratcheting mechanism 22 is shown being attached to the circuit breaker operating mechanism enclosure 13 by means of bolts 67 and threaded apertures 68 and the push rod-guide tube assembly 56, hereafter "guide assembly", is shown beneath the circuit breaker closing button 20 within the circuit breaker cover 12 shown in phantom. The threaded aperture 71 in the top surface of the circuit breaker operating mechanism enclosure 13 receives the threaded end 69 on the bottom of the hexagonal rod 57 and positions the elongated slot 65 on the L-shaped plate 61 opposite the release pin 77 extending from the bell crank 42. A part of the connector plate 23A that supports the operating handle 18 is removed to detail the capture of the release pin 47, extending from the end of the lever arm 43 on the bell crank 42, behind the release tab 53 extending from the bottom of the release lever 48 FIG. 2). The holding prop 44 at the center of the pivot shaft 46 is shown abutting against the roller bearing 54 in FIG. 5.

Figure 5:
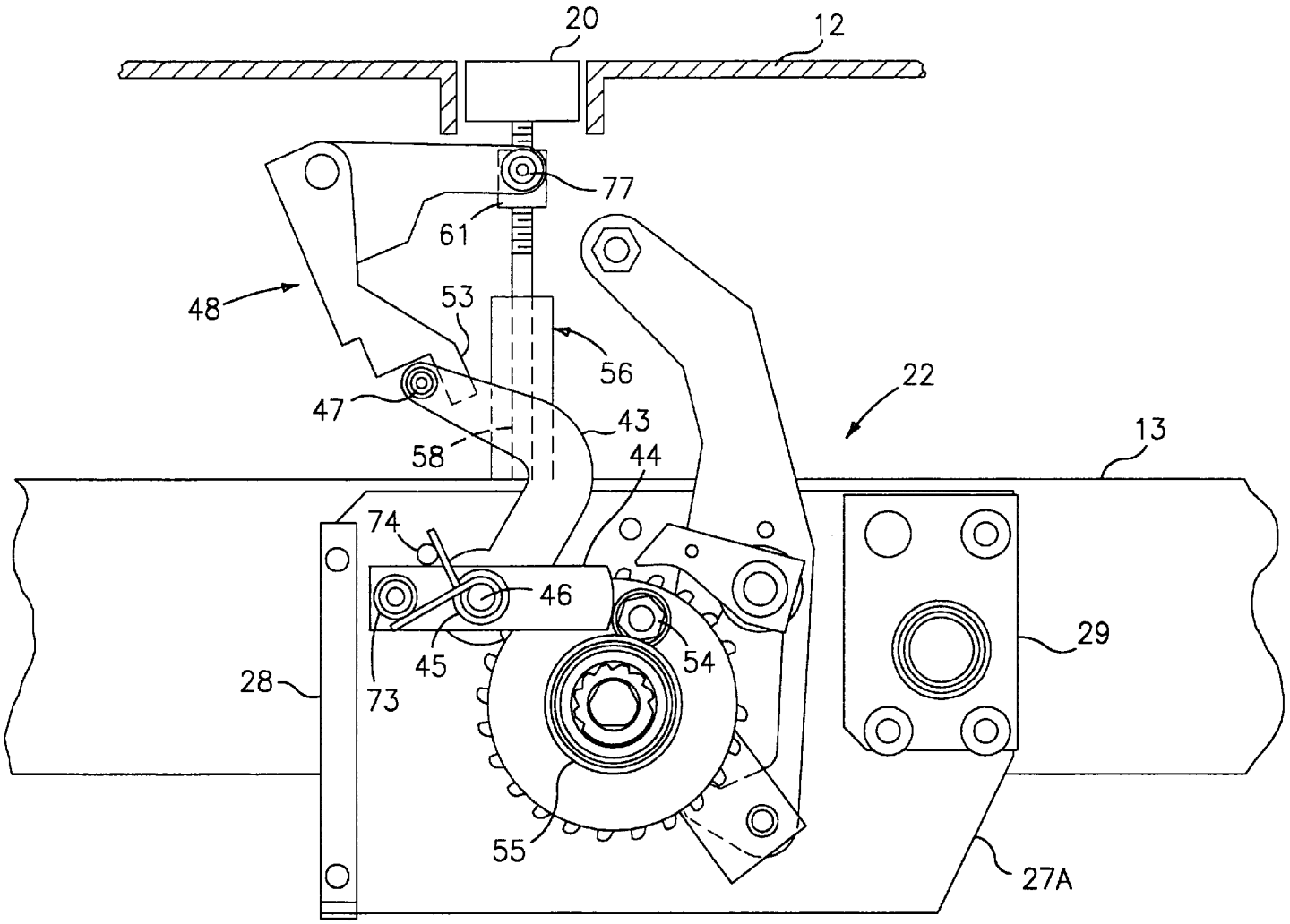
FIG. 5 is an enlarged side view of a part of the ratcheting mechanism of FIG. 4 with the circuit breaker closing springs button in a home position.

The ratcheting mechanism 22 is shown in FIG. 5 with the guide assembly 56 attached to the top of the operating mechanism enclosure 13 and the charging gear 55 rotated to the closing springs fully-charged position with the roller bearing 54 abutting against the end of the holding prop 44. The holding prop is biased against the roller bearing by the bias produced by the prop spring 45 around the pivot shaft 46 having the ends of the spring positioned behind the spring post 73 on the holding prop 44 and the pivot shaft 74 extending between the ratcheting mechanism sideframes 27A, 27B (not shown). The charging gear 55 is arranged between the block spacers 28, 29. The holding prop 44 was shown in FIG. 4 to be connected with the lever arm 43 by means of the pivot shaft 46 and the release pin 47 on the lever arm was also depicted captured behind the release tab 53 extending from the bottom of the bell crank 42. The release pin 47 is captured within the L-shaped plate 61 and the circuit breaker close button 20 is in its "home" position within the circuit breaker cover 12.

Figure 6:
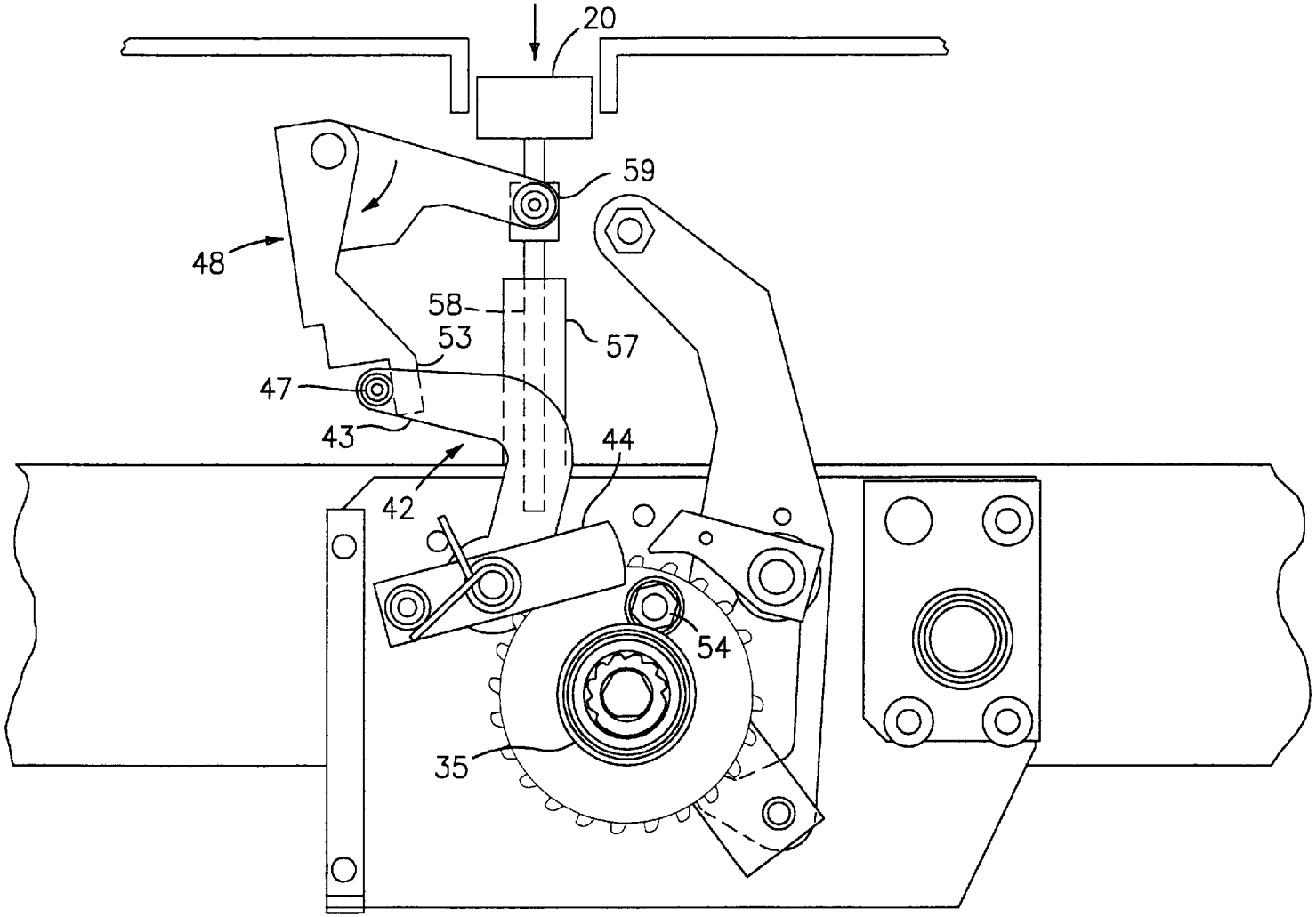
FIG. 6 is an enlarged side view of a part of the ratcheting mechanism of FIG. 4 with the circuit breaker closing springs button in an actuated position.

To release the circuit breaker closing springs, the closing button 20 is depressed, thereby rotating the release lever 48 in the clockwise direction as shown in FIG. 6. The clockwise rotation of the release lever 48 drives the release tab 53 against the release pin 47 on the lever arm 43 thereby rotating the lever arm on the bell crank 42 in the counter-clockwise direction and moving the holding prop 44 away from the roller bearing 54 to allow rotation of the charging shaft 35 under the powerful bias exerted by the circuit breaker closing springs to close the circuit breaker contacts 16, 17 of FIG. 1.

We claim:

1. A ratcheting mechanism for circuit breaker contact closing springs comprising:

a pair of opposing sideframes;

a charging pawl within said sideframes and arranged for interacting with a circuit breaker closing springs shaft;

an operating handle extending above said sideframes;

a charging link connecting between said operating handle and said charging pawl for transfer of charging force from said operating handle to said charging pawl;

a holding pawl engaged with said charging shaft to prevent reverse rotation of said charging shaft when said charging force is applied thereto; and a mechanism disposed within said sideframes selectively preventing or allowing rotation of said charging shaft after said circuit breaker closing springs are fully charged, said mechanism including a bell crank and a release lever, said bell crank including a holding prop extending therefrom contacting a roller on said charging shaft, wherein said release lever includes a release tab extending from a bottom of said release lever and a first release pin extending from a top of said bell crank to release said holding prop from said roller; and a guide assembly consisting of an elongated rod for contact with the bottom of a circuit breaker closing button and top plate defining an elongated slot, whereby a second release pin is captured within said elongated slot for rotation of said release lever upon depression of said closing button.

2. The ratcheting mechanism of claim 1 wherein said guide assembly further includes a hexagonal rod defining a central aperture coextensive therewith, said elongated rod being captured within said central aperture.

3. The ratcheting mechanism of claim 2 wherein said hexagonal rod includes a bottom end and a shoulder end, said bottom end engaged within a top surface of a circuit breaker operating mechanism enclosure, said ratcheting mechanism further including a spiral spring arranged about said elongated rod, said spiral spring positioned intermediate said top plate and said shoulder end of said hexagonal rod for biasing an end of said elongated rod into contact with said bottom of said closing button.

4. The ratcheting mechanism of claim 3 wherein said hexagonal rod is engaged within said top surface of a circuit breaker operating mechanism enclosure such that said guide assembly is positioned under said circuit breaker closing button.

5. A circuit breaker comprising:

a support frame;

an operating mechanism within said support frame, said operating mechanism including a contact closing spring;

a moveable contact arm interacting with said contact closing spring opening and closing a pair of contacts;

a trip unit interacting with said operating mechanism articulating said operating mechanism to separate said contacts upon command;

a pair of opposing sideframes;

a charging pawl within said sideframes and arranged for interacting with a contact closing spring charging shaft;

an operating handle extending above said sideframes;

a charging link connecting between said operating handle and said charging pawl for transfer of charging force from said operating handle to said charging pawl;

a holding pawl engaged with said charging link to prevent reverse rotation of said charging shaft when said charging force is applied thereto;

a mechanism disposed within said sideframes preventing reverse rotation of said charging shaft after said contact spring is fully charged, said mechanism including a bell crank and a release lever, said bell crank including a holding prop extending therefrom contacting a roller on said charging shaft, wherein said release lever includes a release tab extending from a bottom of said release lever and a first release pin extending from a top of said bell crank to release said holding prop from said roller; and an elongated rod for contact with the bottom of a circuit breaker closing button and top plate defining an elongated slot, whereby a second release pin is captured within said elongated slot for rotation of said release lever upon depression of said closing button.

6. The circuit breaker of claim 5 wherein said guide assembly further includes a hexagonal rod defining a central aperture coextensive therewith, said elongated rod being captured within said central aperture.

7. The circuit breaker of claim 6 wherein said hexagonal rod includes a bottom end and a shoulder end, said bottom end engaged within a top surface of a circuit breaker operating mechanism enclosure, said circuit further including a spiral spring arranged about said elongated rod, said spiral spring positioned intermediate said top plate and said shoulder end of said hexagonal rod for biasing an end of said elongated rod into contact with said bottom of said closing button.

8. The circuit breaker of claim 6 wherein said hexagonal rod is engaged within said top surface of a circuit breaker operating mechanism enclosure such that said guide assembly is positioned under said circuit breaker closing button.

* * * * *